US011241783B2

(12) United States Patent
Burry

(10) Patent No.: US 11,241,783 B2
(45) Date of Patent: Feb. 8, 2022

(54) ADJUSTABLE WORKING STAND COMBINED WITH MAGNETIC HARDWARE ORGANIZER

(71) Applicant: James Michael Burry, Troutman, NC (US)

(72) Inventor: James Michael Burry, Troutman, NC (US)

( * ) Notice: Subject to any disclaimer, the term of this patent is extended or adjusted under 35 U.S.C. 154(b) by 0 days.

(21) Appl. No.: 15/929,331

(22) Filed: Apr. 27, 2020

(65) Prior Publication Data

US 2020/0338715 A1 Oct. 29, 2020

Related U.S. Application Data

(60) Provisional application No. 62/838,581, filed on Apr. 25, 2019.

(51) Int. Cl.
*B25H 1/00* (2006.01)

(52) U.S. Cl.
CPC ..... *B25H 1/0042* (2013.01)

(58) Field of Classification Search
CPC ..... B25H 1/00; B25H 1/0007; B25H 1/0014; B25H 1/14; B25H 1/16; B25H 1/18; A47B 2200/0043; A47B 2200/0044; B66F 7/22; B66F 2700/12; B66F 2700/123; B66F 2700/126
See application file for complete search history.

(56) References Cited

U.S. PATENT DOCUMENTS

| | | | | |
|---|---|---|---|---|
| 4,397,245 | A * | 8/1983 | Washburn | B25H 1/18 108/7 |
| 4,420,164 | A | 12/1983 | Mitchell | |
| 5,385,280 | A | 1/1995 | Littlepage et al. | |
| 5,518,224 | A | 5/1996 | Anderson | |
| 6,241,104 | B1 | 6/2001 | Kraus | |
| 7,028,850 | B1 | 4/2006 | Sargisian | |
| 7,100,928 | B1 | 9/2006 | VanValkenburgh | |
| 8,016,312 | B2 | 9/2011 | MacEachern | |
| 8,360,252 | B1 | 1/2013 | Fagan | |
| 8,413,963 | B2 | 4/2013 | Pacheco, Jr. | |
| 8,485,369 | B2 | 7/2013 | Glover | |
| 8,517,343 | B1 | 8/2013 | VanValkenburgh | |
| 8,616,514 | B1 | 12/2013 | Baxter et al. | |
| 8,826,504 | B1 * | 9/2014 | Slivon | B25B 27/0035 29/239 |
| 2006/0045685 | A1 | 3/2006 | Warner et al. | |
| 2009/0045380 | A1 | 2/2009 | Aiken | |
| 2011/0094976 | A1 | 4/2011 | Pratt et al. | |
| 2012/0187258 | A1 * | 7/2012 | Testaverde | B25H 1/04 248/146 |

* cited by examiner

*Primary Examiner* — Tyrone V Hall, Jr.

(57) ABSTRACT

A motorbike stand is provided. The motorbike stand has a top portion pivotably connected to a base portion along one end of the top portion; one or more adjustable segments associated with another end in such a way that an angle of incident defined by the base portion and top portion is linearly adjustable; and one or more magnetic portions provided along the base portion.

6 Claims, 4 Drawing Sheets

ADJUSTABLE WORKING STAND COMBINED WITH MAGNETIC HARDWARE ORGANIZER

CROSS-REFERENCE TO RELATED APPLICATION

This application claims the benefit of priority of U.S. provisional application No. 62/838,581, filed 25 Apr. 2019, the contents of which are herein incorporated by reference.

BACKGROUND OF THE INVENTION

The present invention relates to working stations or stands and, more particularly, to a work stand with an adjustable top portion and a magnetic hardware organizer.

The currently problems with today's motorbike stands are twofold: first, the motorbikes do not sit level on existing stands, and as a result the front or rear tire often touches the ground, which prevents proper maintenance; and second, the tools, nuts, bolts, parts from being lost or scattered while maintaining and or working on the motorcycle.

Existing motorcycle stands are basic crates that hold a motorcycle partially about the ground. Current motorcycle stands have a basic horizontal top; however, every motorcycle has a different angle on the chassis, and so when the motorcycle chassis sits on top of an existing motorcycle stand the motorcycle naturally sits at an angle; often, the front or rear wheel touches the ground. Current motorcycle stands also offer little or no options for tool and part storage and organization during the maintenance process.

As can be seen, there is a need for a work stand with an adjustable top portion and a magnetic hardware organizer.

The work stand embodied in the present invention enables the user to set the angle of the top portion of the work stand relative to a base portion for, among other things, setting an angle of a motorcycle chassis supported by the top portion, so that the motorcycle sits level when placed on the stand and both tires rest high in the air. The magnet hardware organizer (of the base portion of the stand) allows the user to easily store and organize metal tools, nuts, bolts, and parts on each side of the stand. No motorcycle stand on the market has an adjustable top to easily level a supported motorcycle, and magnets portions to hold and organize the hardware for working on the motorcycle.

SUMMARY OF THE INVENTION

In one aspect of the present invention, a working stand providing the following: a top portion; a base portion; at least one adjustable segment interconnecting said portions along a first end; one or more pivotable attachment points pivotably connecting said portions along a second end; and each adjustable segment linearly movable between a retracted condition and an extended condition, whereby moving each adjustable segment alters an angle of incidence between said portions.

In another aspect of the present invention, the working standing further includes the following: one or more magnetic portions provided the base portion; a coupler providing two openings communicating to an inner circumference; coupler threads along the inner circumference; a threaded shaft; a reverse-threaded shaft; and said threaded shafts operatively associated with one of the two openings, wherein rotating the coupler urges the threaded shaft to thread in an opposite direction as the reverse-threaded shaft; the top portion having at least two vertices along the first end; and the at least one adjustable segment being two adjustable segments, each adjustable segment engaging one of two vertices in such a way that the two vertices can be at different elevations relative to each other in relationship to the base portion; and each adjustable segment having a locking unit enabling a locked engagement between the threaded shaft and the coupler.

In yet another aspect of the present invention, a motorbike stand includes the following: a top portion pivotably connected to a base portion along one end of the top portion; one or more adjustable segments associated with another end in such a way that an angle of incident defined by the base portion and top portion is linearly adjustable; and one or more magnetic portions provided along the base portion.

In yet another aspect of the present invention, a method of supporting a motorbike for maintenance includes the following: providing the above-mentioned motorbike stand; placing the motorbike on the top portion; adjusting each adjustable segment in such a way that the motorbike is level relative to a supporting surface; and removably storing hardware above the supporting surface by magnetically attaching said hardware to the one or more magnetic portions.

These and other features, aspects and advantages of the present invention will become better understood with reference to the following drawings, description and claims.

DETAILED DESCRIPTION OF THE INVENTION

Figure 1:
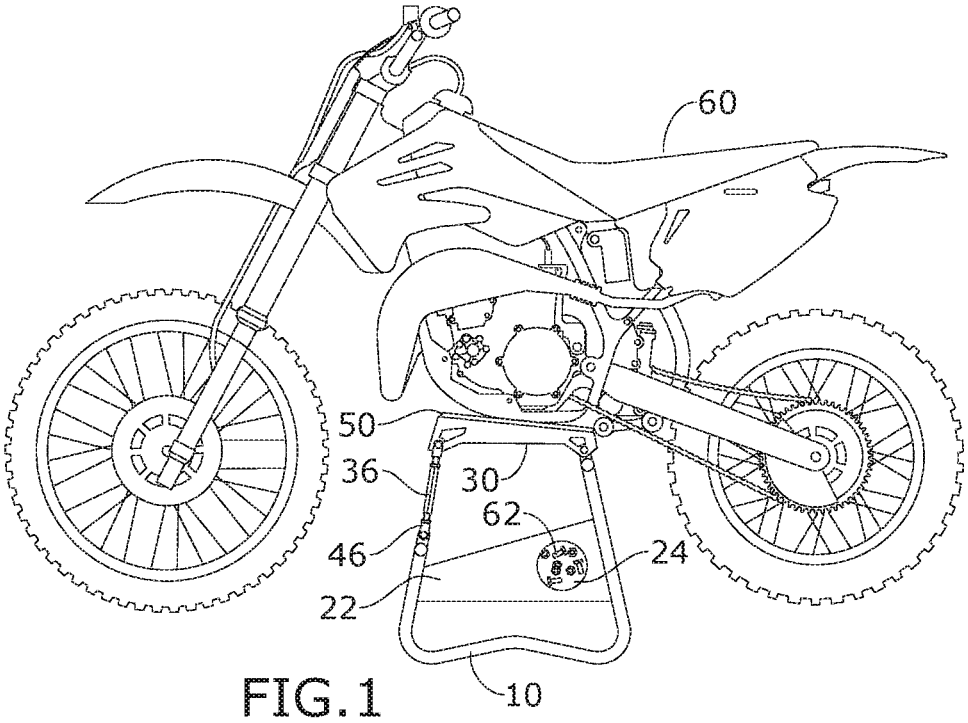
FIG. 1 is a front elevation view of an exemplary embodiment of the present invention shown in use supporting a vehicle 60 and holding hardware 62.
Figure 2:
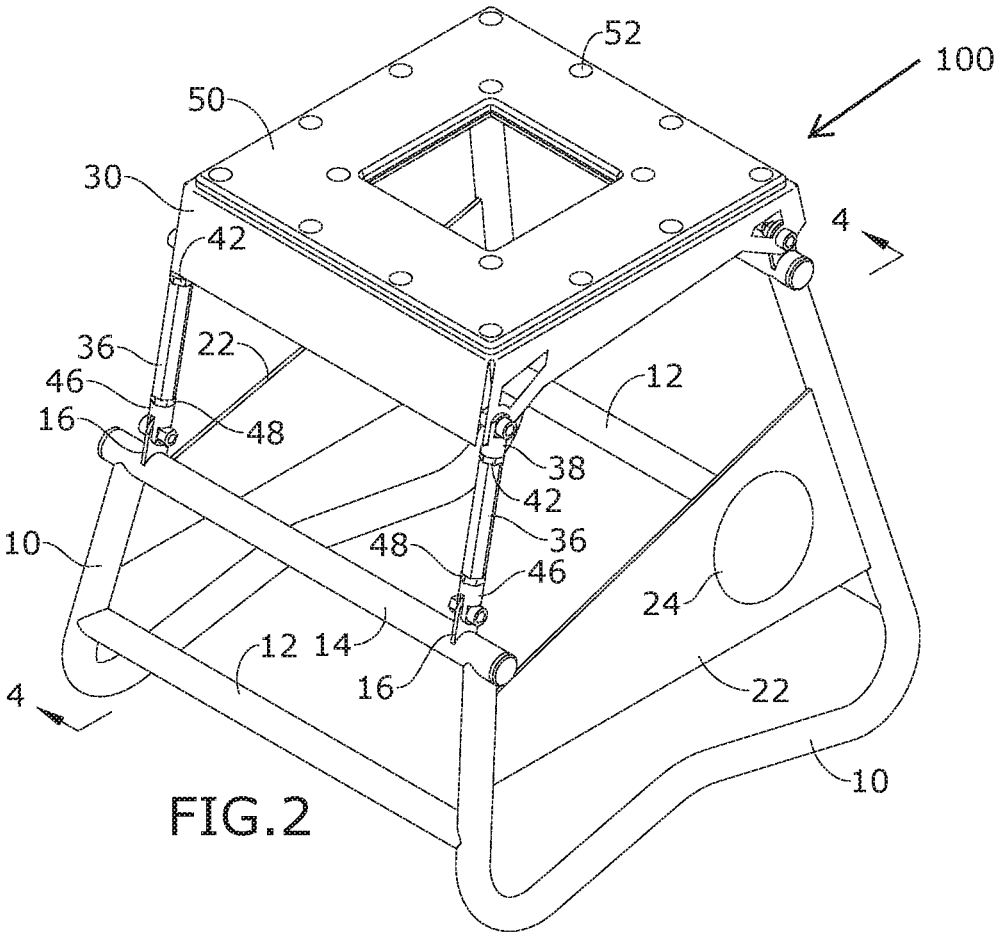
FIG. 2 is a perspective view of an exemplary embodiment of the present invention.
Figure 3:
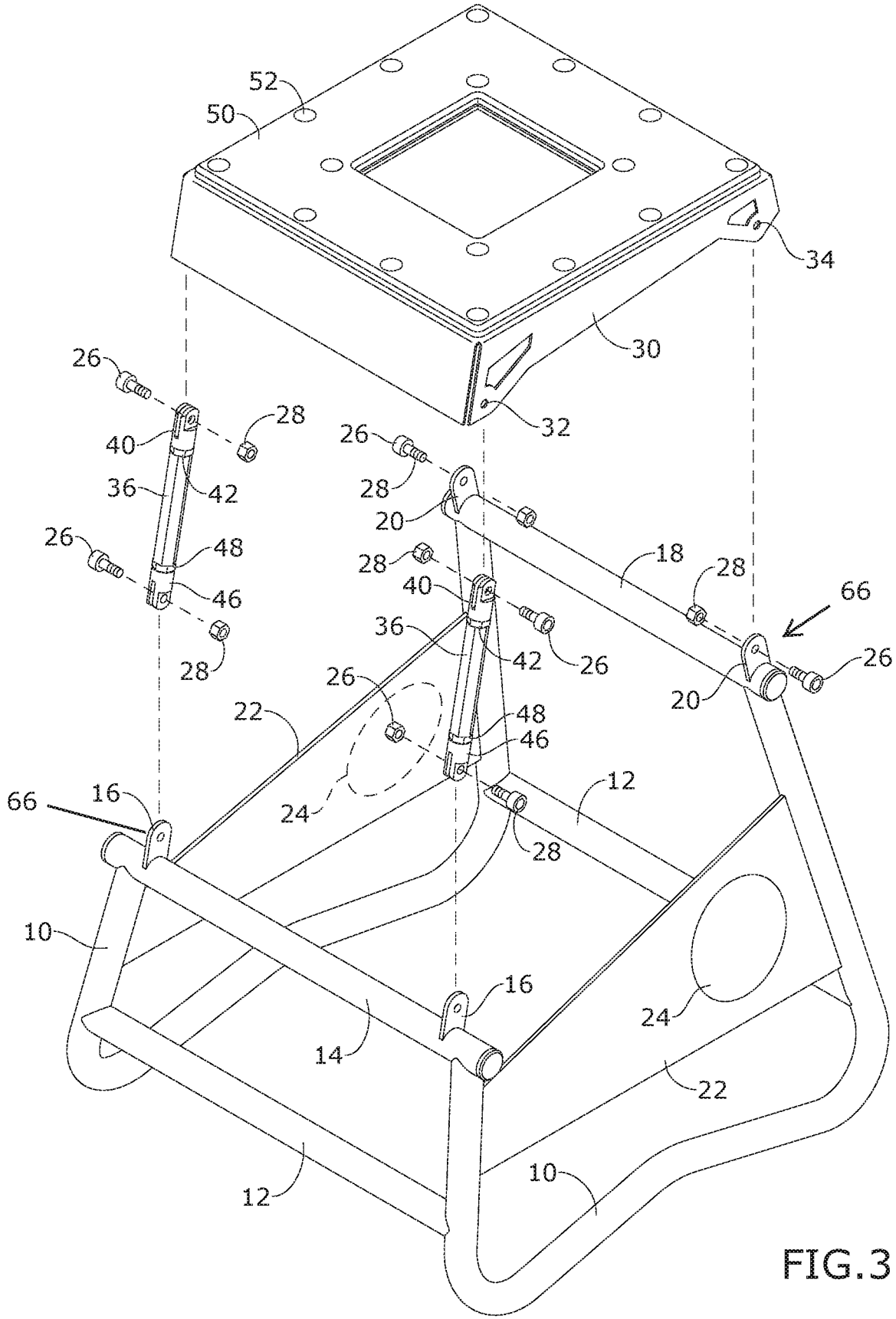
FIG. 3 is an exploded perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a motorbike stand includes the following: a top portion pivotably connected to a base portion along one end of the top portion; one or more adjustable segments associated with another end in such a way that an angle of incident defined by the base portion and top portion is linearly adjustable; and one or more magnetic portions provided along the base portion.

Referring to FIGS. 1 through 7, the present invention may include an adjustable work stand 100. The work stand 100 may include a base portion 10 and a top portion 30 interconnected by adjustable segments 70 along a first end 71 of the work stand 100.

The top portion 30 may provide a mat 50 secured by mat fasteners 52. The top portion 30 may extend between the first end 71 and an opposing second end 72. The second end 72 may provide at least one pivotable attachment point 66 with the base portion 10. In certain embodiments, each pivot attachment point 66 may include a tab 20 along the base portion 10 providing a base pivot hole through which a pivot member 26 operatively associates in concert with a top pivot hole 34 of the second end 72 of the top portion 30, whereby the top portion 30 can move pivotably relative to the base portion 10 about said second end 72. Fasteners 28 may facilitate the operability of the pivotable attachment point 66.

The base portion 10 may include a frame for supporting the top portion 30 on a supporting surface, such as the ground. The base portion 10 may include metallic or plasticize members, such as tubular members. The base portion 10 may include with spaced apart column members extending generally upward from the supporting surface. Extending between the column members may be lower crossbars 12 and first and second upper crossbars 14 and 18. The first crossbar 14 may be associated with the first end 71, while the second crossbar 18 may be associated with second end 72. The second crossbar 18 may be at a higher elevation than the first crossbar 14 relative to the supporting surface. The first upper crossbar 14 may provide pivotable attachment points 66 that align with the pivotable attachment points 66 of the second upper crossbar 18. Each pivot attachment point 66 may include a tab 16 providing a base pivot hole through which a pivot member 26 operatively associates the adjustable segment 10. Fasteners 28 may facilitate the formation of the pivotable attachment point 66.

Figure 4:
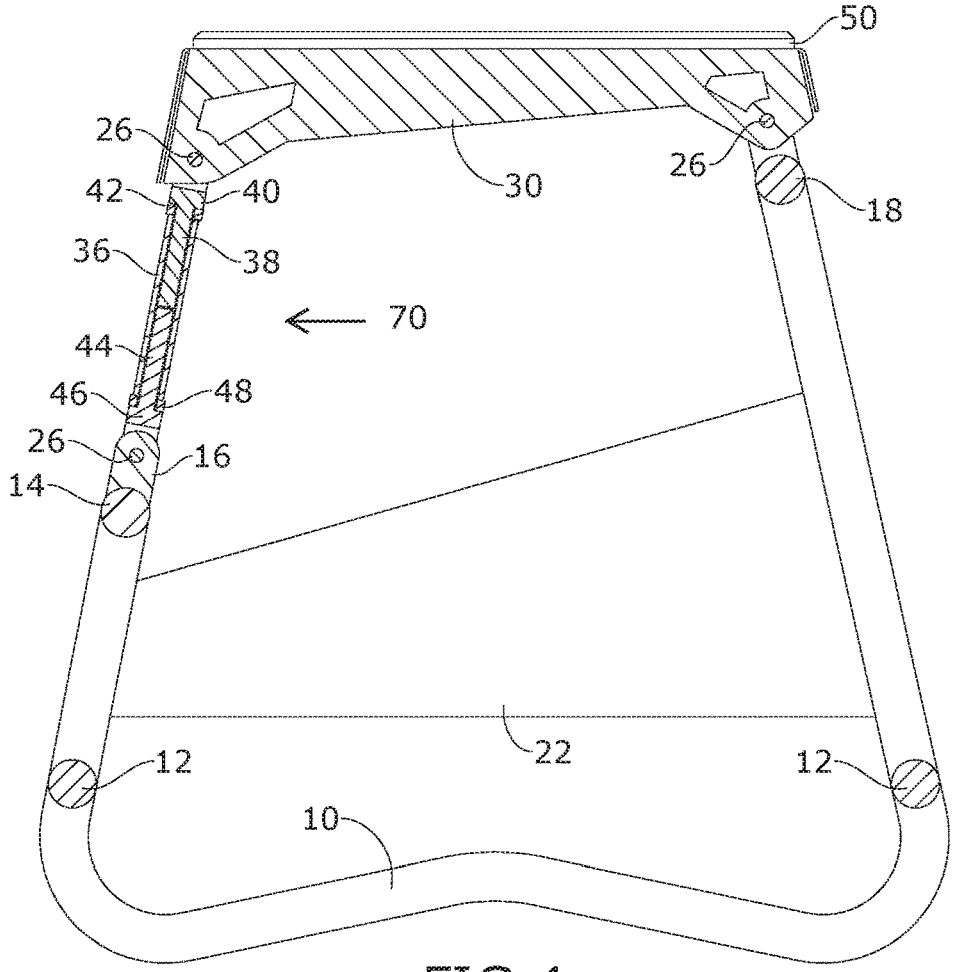
FIG. 4 is a section view of an exemplary embodiment of the present invention, taken along line 4-4 in FIG. 2, illustrating a retracted position wherein the adjustable segment 70 is in a fully sheathed condition.
Figure 5:
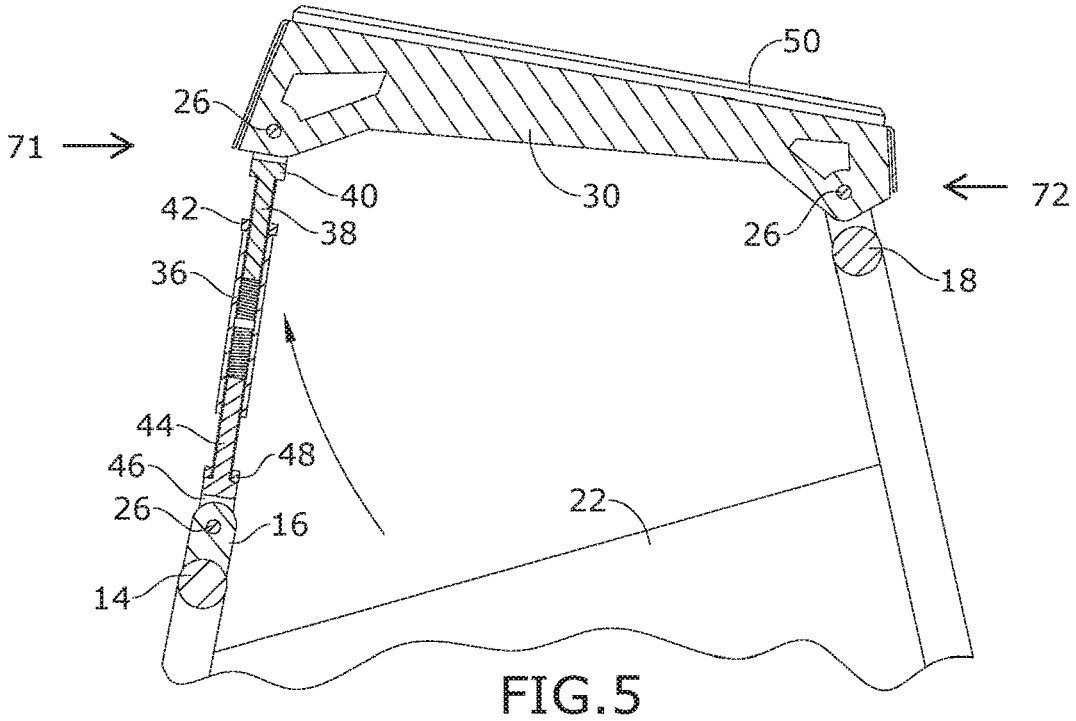
FIG. 5 is a section view of an exemplary embodiment of the present invention, illustrating moving a top portion 30 to an extended position as the adjustable segment moves toward a fully removed condition.
Figure 6:
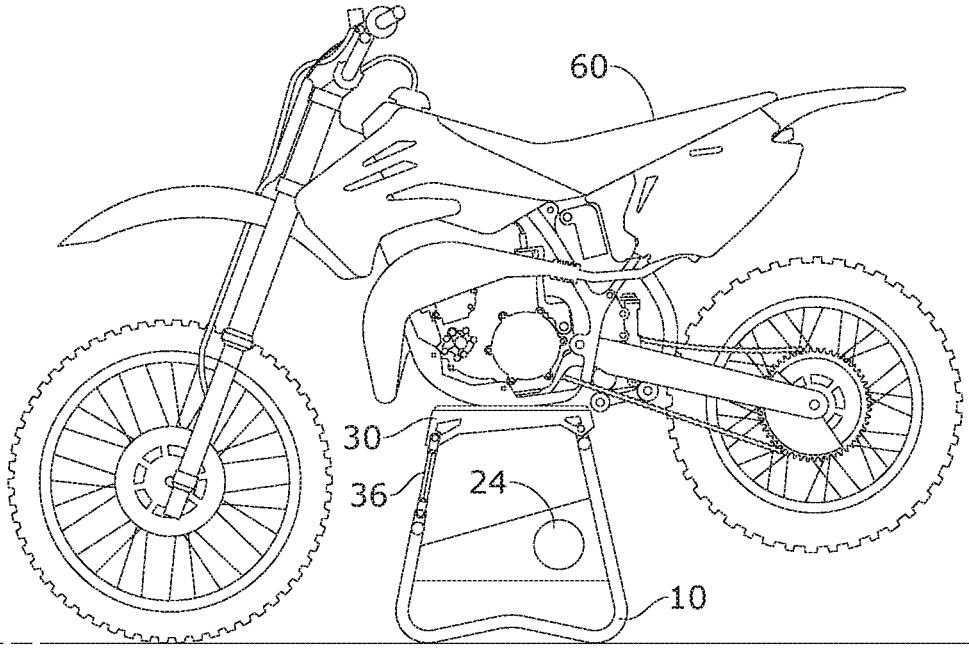
FIG. 6 is a front view of an exemplary embodiment of the present invention, with the top portion 30 horizontal in a retracted condition, shown holding vehicle 60.
Figure 7:
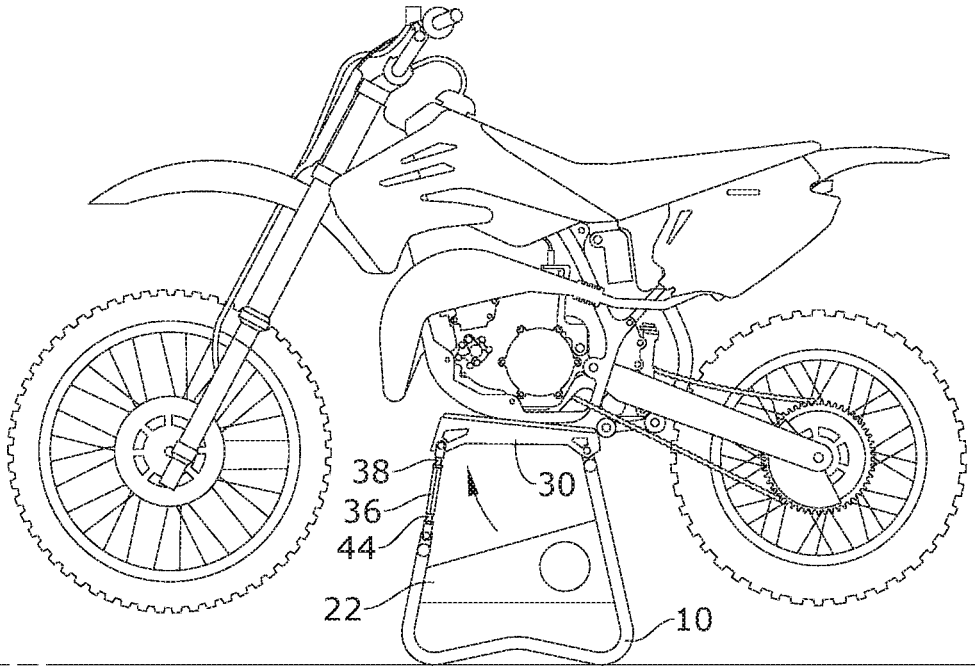
FIG. 7 is a section view of an exemplary embodiment of the present invention, illustrating the top portion 30 in one of many possible extracted conditions adjusted at an angle to level vehicle 60.

The adjustable segment 70 may include a hollow coupler 36 having opposing open ends, each open end dimensioned to receive a threaded shaft 38 and 44, respectively. The coupler 36 may provided threading along its inner circumference that mates with the threaded shafts 38 and 44 so that each threaded shaft 38 or 44 may selectively engage the inner diameter of the coupler 36 so as to move linearly anywhere between a fully removed condition and fully sheathed condition in the coupler 36, as illustrated in FIGS. 4 and 5. Each threaded shaft 38 and 44 may have a locking unit 48 or 42 that may engage both the coupler 36 and the threaded shaft 38 or 44.

Each threaded shaft 38 and 44 may end in a clevis 40 or 46 having a pivot hole to operatively associate with the pivotable attachment point 66 of the first crossbar 14 and a pivot hole 32 provided by the first end 71 of the top portion 30.

The adjustable segment 70 enables a user to selectively adjust and set the angle of the top portion of the stand 100 relative to the base portion 10 and by extension the supporting surface. In other words, the adjustable segment enables the first end 71 of the top portion 30 to move linearly upward and downward relative the second end 71, between an extended position and an retracted position.

In some embodiments, the user may place the motorbike 60 on the top portion 30, and if the motorbike 60 does not sit level, the user can simply adjust the threaded shafts 38 and 44 relative to the coupler 36—i.e., moving either or both threaded shafts toward the fully removed condition to raise/extend the top portion 30 or moving either or both threaded shafts toward the fully sheathed condition to lower/retract one side of the top portion 30 of the work stand 100. Such actions change the angle of the top portion 30 of the work stand 100 and therefore adjust the angle of the support vehicle or object 60.

In certain embodiments, the two threaded shafts 38 and 44 may be threaded turnbuckle bolts that "screw" in and out of the coupler 36—which is a tubular threaded body in between the two threaded shafts 38 and 44. Each threaded shaft may be made of a self-lubricating polymer, such as nylon. One of the thread types (of the bolt or the coupler) may be a thread type reverse relative to the other. As a result, when the coupler body of the turnbuckle is rotated, the threaded bolts either thread into the coupler-body, making the overall adjustable segment 70 length shorter, or they thread out of the body making the overall adjustable segment 70 length longer. As the adjustable segment 70 changes length it changes the angle of the top of the stand.

Because of the above-mentioned reversed threading, the angle of the top portion 30 can be adjusted by rotating the coupler 36 which either threads the threaded shaft 38 in a first direction while simultaneously threading the threading shaft 44 in a second direction; the second direction being linearly opposite of the first direction. In turn, the adjustable segment 70 by way of the clevis 40 moves the top portion 30 up or down, adjusting its angle relative to the base portion 10, as the top portion is rotated on the pivotable attachment points 66 associated with the second end 72. The handle like shape of the coupler 36 allows for easy rotation of the adjustable segment 70.

As there are two adjustable segments 70, the top portion 30 may have four corners, where three of the corners are at different elevations (the two second end 72 corners at a lowest elevation and the two opposing first end corners at different elevations relative to each other). Such a "skewed" orientation may facilitate some repairs to hard-to-reach portions of the vehicle 60. The adjustable segments 70 may be accomplished by other structural components so long as the work stand 100 enables the user to selectively set the proper angle of the top portion 30 of the stand 10 to make his/her vehicle/object 60 sit level or other desired orientation.

Extending between the column member may be side panels 22 having a magnetic portion 24. The magnetic portion 24 enables the user to organize metallic or otherwise magnetically attracted hardware 62, such as tools, parts, nuts, bolts, etc., on the side panels 22, securely holding this hardware 62 within arm's reach and preventing them from being scattered or lost during maintenance. The magnets portion 24 may include embedded magnets or magnets are then glued into pockets on the inside of the side panels 22 where stickers are placed over the magnets to allow a graphic element and hide the magnets.

A method of using the present invention may include the following. The stand 100 disclosed above may be provided. A user may place their vehicle 60 on the top portion 30 thereof. Then the user may engage one or both of the adjustable segments 70 to either sit the vehicle 60 level (say, relative to a surface supporting the user) or at an angled orientation suitable for the work the user intends on doing to the vehicle 60. The locking units 42 and 48 enables the user to removably lock the adjustable segments 70 are a particular condition between fully removed condition and a fully sheathed condition, and so the top portion 30 at a desired angular position relative to the base position 10. During motorcycle maintenance, the user may removably attached paramagnetic hardware 82 to the magnetic portions 24 to hold the hardware 62 securely in place and prevent them from being scattered or lost.

Additionally, the stand 100 embodied in the present invention could be used for all motorcycles (dirt, street, enduro, etc.), as well as for ATVs, side-by-sides, go-karts, bicycles, electric-bikes, mopeds, and powersports vehicles. Furthermore, the stand 100 is not limited to motorcycles. It could be used as a general mechanics stand with an adjustable top to better secure whatever object is sitting on it.

It should be understood, of course, that the foregoing relates to exemplary embodiments of the invention and that modifications may be made without departing from the spirit and scope of the invention as set forth in the following claims.

What is claimed is:

1. A stand, comprising:

a top portion comprising: a planar mat; and a first pair and second pair of pivot points, wherein the first pair are along a first end of the top portion and the second pair are along a second end opposite the first end, wherein the first pair is at a different upper elevation than the second pair relative to the planar mat;

a base portion comprising: a supporting surface; a third pair and fourth pair of pivot points, wherein the third pair are along a first end of the base portion and the fourth pair are along a second end of the base portion opposite the first end of the base portion, wherein the third pair is at a different lower elevation than the fourth pair relative the supporting surface;

two adjustable segments operatively associating the first and third pairs of pivot points and the second and fourth pair of pivot points respectively; and each adjustable segment linearly movable between a retracted condition and an elevated condition, whereby moving each adjustable segment alters an angle of incidence between said top and bottom portions.

2. The stand of claim 1, further comprising:

the base portion having one or more magnetic portions.

3. The stand of claim 1, wherein each adjustable segment comprises:

a coupler providing two openings communicating to an inner circumference;

coupler threads along the inner circumference;

a threaded shaft;

a reverse-threaded shaft; and said threaded shafts operatively associated with one of the two openings, wherein rotating the coupler urges the threaded shaft to thread in an opposite direction as the reverse-threaded shaft.

4. The stand of claim 3, wherein the two adjustable segments engaging the two pivot points of the first pair of pivot points in such a way that said two pivot points are at different elevations relative to each other in relationship to the base portion, whereby a skewed orientation of the top portion is enabled for facilitating repairs to hard-to-reach portion of a supported vehicle.

5. The stand of claim 4, further comprising:

each adjustable segment having a locking unit enabling a locked engagement between the threaded shaft and the coupler.

6. The stand of claim 5, further comprising:

one or more magnetic portions provided the base portion.

* * * * *